US005984567A

United States Patent [19]

Gollin et al.

[11] Patent Number: 5,984,567

[45] Date of Patent: Nov. 16, 1999

[54] MOLDED SPLIT SLEEVE BUSHING FOR CHAIR BASE

[75] Inventors: Timothy J. Gollin, Houston; Dale W. Mason, Sugar Land, both of Tex.

[73] Assignee: Gollin & Co., Inc., Houston, Tex.

[21] Appl. No.: 09/112,462

[22] Filed: Jul. 9, 1998

[51] Int. Cl.[6] ..... B25G 3/20

[52] U.S. Cl. ..... 403/371; 403/344; 297/463.1; 297/344.19; 248/404; 248/161

[58] Field of Search ..... 248/404, 631, 248/161; 297/463.1, 344.19; 403/371, 361, 344

[56] References Cited

U.S. PATENT DOCUMENTS 4,899,969 2/1990 Bauer et al. ..... 248/161

5,702,083 12/1997 Lai ..... 248/404

*Primary Examiner*—Lynne Reichard
*Assistant Examiner*—David E. Bochna
*Attorney, Agent, or Firm*—Kuffner & Associates

[57] ABSTRACT

A split sleeve bushing for providing a tight fit between a support post and chair base comprises two hemi-cylindrical components which mount about the support post and are received within the support post receptacle of the chair base. The split sleeve bushing includes external stability rings and vertical ribs extending along the external surface thereof. The vertical ribs are tapered to match the draft angle of the support post receptacle of the chair base. The upper end of the split sleeve bushing includes a circumferential flange which is slotted for snap lock engagement with the chair base.

6 Claims, 3 Drawing Sheets

FIG. 4
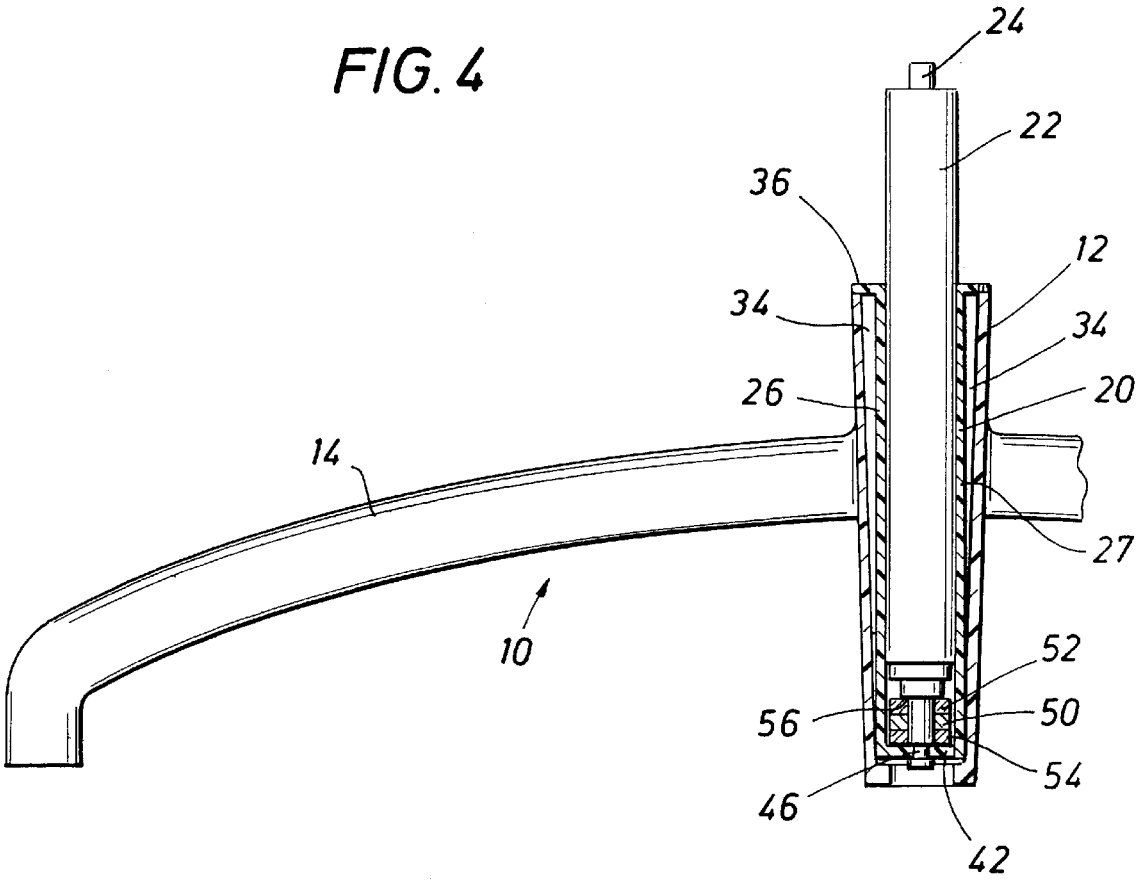
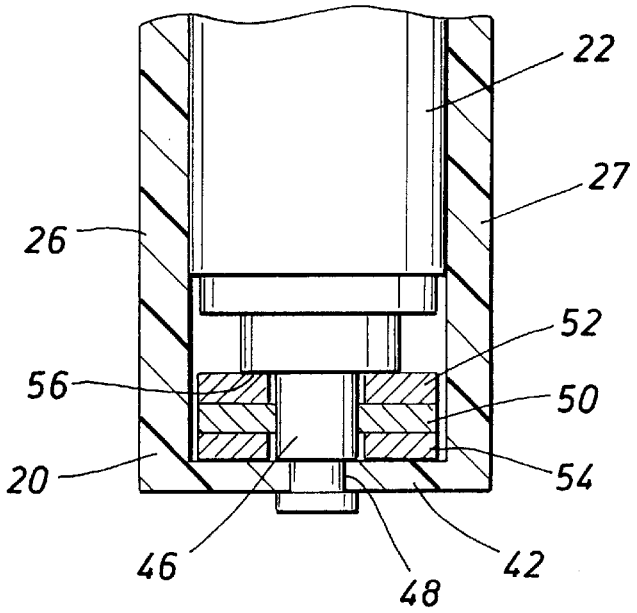
FIG. 5

MOLDED SPLIT SLEEVE BUSHING FOR CHAIR BASE

BACKGROUND OF THE INVENTION

The present invention relates to adjustable chairs, and more particularly to a molded split sleeve bushing for a gas cylinder chair seat support mechanism securing the chair seat to the chair base.

The chair design industry has heretofore provided a wide variety of chairs for the office environment which are ergonomically designed for the comfort of the user. These chairs include various adjustment mechanisms to accommodate the particular needs of the users. Adjustable chairs may, for example, include seat height adjustment mechanisms for raising and lowering the seat height relative to the base of the chair to accommodate anatomical variations of different users. Some height adjustment mechanisms employ a screw type drive for altering the height of the chair seat, while other adjustment mechanisms include a ratchet type mechanism or gas cylinder to raise and lower the chair seat.

A common problem with available height adjustable chairs is that they tend to wobble or feel loose. Typically, the chair seat support post, which may include a threaded surface for the screw type drive, is mounted to a metal or wooden base. The support post is usually metal and after a period of time the support post receptacle in the wooden base supporting the metal post wears and enlarges. Consequently, the metal post is not firmly secured within the wooden base and wobbles slightly when users sit in the chair or shift positions on the chair seat.

Similarly, metal or molded chair base assemblies develop excessive wear and unwanted movement or play between the support post and the base. Cumulative tolerances on the width and thickness of the metal components, paint coat thickness and tolerances of the molded plastic components all combine to create objectionable rattle and play in the final assembly. It is difficult to maintain a tight fit between a metal-to-metal or metal-to-plastic interface. Metal components typically include rough surfaces and sharp edges which quickly wear at the metal or metal-to-plastic interface resulting in a loose and wobbling support post for the chair seat.

A need exists for a multi-position height adjustable chair, which permits a wide latitude in vertical positioning, which is relatively easily manufactured, which is reliable in operation and which provides a wide variety of adjustable positions for the user.

It is, therefore, an object of the invention to provide a substantially wobble-free, multi-position height adjustable chair.

It is another object of the invention to provide a height adjustable chair in which the height adjustment mechanism utilizes a gas cylinder support post for height adjustment.

It is a further object of the invention to provide a height adjustable chair which minimizes wobble by reducing the tolerances between the gas cylinder support post and the chair base.

It is a further object of the invention to provide a height adjustable chair utilizing a molded split sleeve bushing for eliminating draft angle problems in the support post receptacle by providing a split sleeve bushing which seats in the draft angle of the chair base support post receptacle, providing a tight fit and smooth surface on which the gas cylinder may ride.

SUMMARY OF THE INVENTION

The present invention is a split sleeve bushing for a height adjustable chair. It is particularly useful for use with gas cylinder chair seat support post mechanisms but is equally usable for other support post configurations for providing a tight fit between the support post and chair base. The split sleeve bushing comprises two hemi-spherical components which mount about a gas cylinder support post and are received within the support post receptacle of the chair base. The split sleeve bushing includes external stability rings and vertical ribs extending along the external surface thereof. The vertical ribs are drafted to match the draft of the support post receptacle of the molded chair base. The upper end of the split sleeve bushing includes a circumferential flange which is slotted for snap lock engagement with the chair base.

BRIEF DESCRIPTION OF THE DRAWINGS

So that the manner in which the above recited features, advantages and objects of the present invention are attained can be understood in detail, a more particular description of the invention, briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

FIG. 4 is a partial section view of the split sleeve bushing of the invention mounted in a chair base; and FIG. 5 is an enlarged, partial section view depicting engagement of the lower end of a gas cylinder support post to the split sleeve bushing of the invention.

DETAILED DESCRIPTION OF A PREFERRED EMBODIMENT

Figure 1:
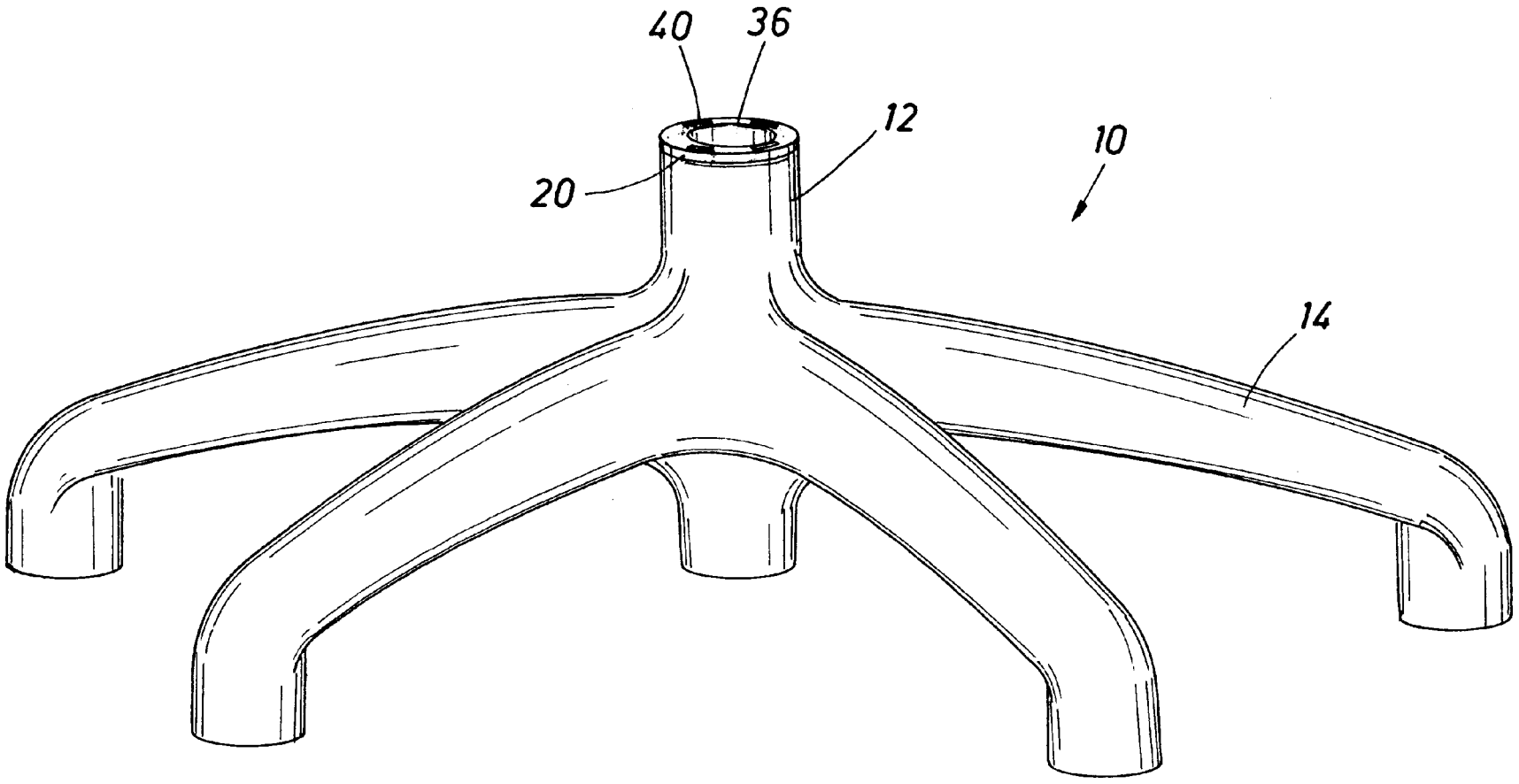
FIG. 1 is a perspective view of a chair base and split sleeve bushing in accordance with the present invention.

A chair base in accordance with the present invention is illustrated in FIG. 1. The chair base, generally identified by the reference numeral 10, comprises a central hub 12 having a number of arms 14 extending radially outward from the hub 12. The chair base 10 illustrated in FIG. 1 is of a typical configuration which may include casters mounted on the distal ends of the arms 12 so that the chair may roll about on a support surface, such as a floor. The particular configuration of the chair base 10 is shown for illustrative purposes and it is understood not to be limiting of the present invention which is described in greater detail hereinafter.

Referring still to FIG. 1, it will be observed that the split sleeve bushing of the present invention, generally identified by the reference numeral 20, is received within the hub 12 of the base 10. The base 10 is fabricated of molded material in compliance with industry standards. The base 10, including the hub 12, may be molded as a single unitary body. The hub 12 is generally cylindrical in shape, open at the top and closed at the bottom. The molding process creates a slight draft in the cylindrically wall of the hub 12 so that the internal diameter of the hub 12 at its upper end is slightly greater than at the bottom of the hub 12.

The hub 12 forms the chair base receptacle for receiving the lower end of the chair seat support post which is anchored to the hub 12. Consequently, the greatest diameter of the chair seat support post may not be greater than the smallest diameter of the hub 12. Thus, height adjustable chairs usually develop slight play or looseness between the chair seat support post and the hub 12 of the base 10.

Referring now to FIG. 4, the sleeve bushing 20 of the present invention is shown received within the hub 12 of the base 10. The bushing 20 encloses the lower portion of chair seat support post 22, which in the preferred embodiment of FIG. 4, is a gas cylinder. A post connector 24 projects from the top of the gas cylinder 22 for connection to a bracket on the bottom of the chair seat (not shown in the drawings) in a customary manner. The gas cylinder 22 may be actuated to raise and lower the chair seat by manipulation of an actuator mechanism (not shown in the drawings) mounted to the bottom of the chair seat or at any other convenient location.

Figure 3:
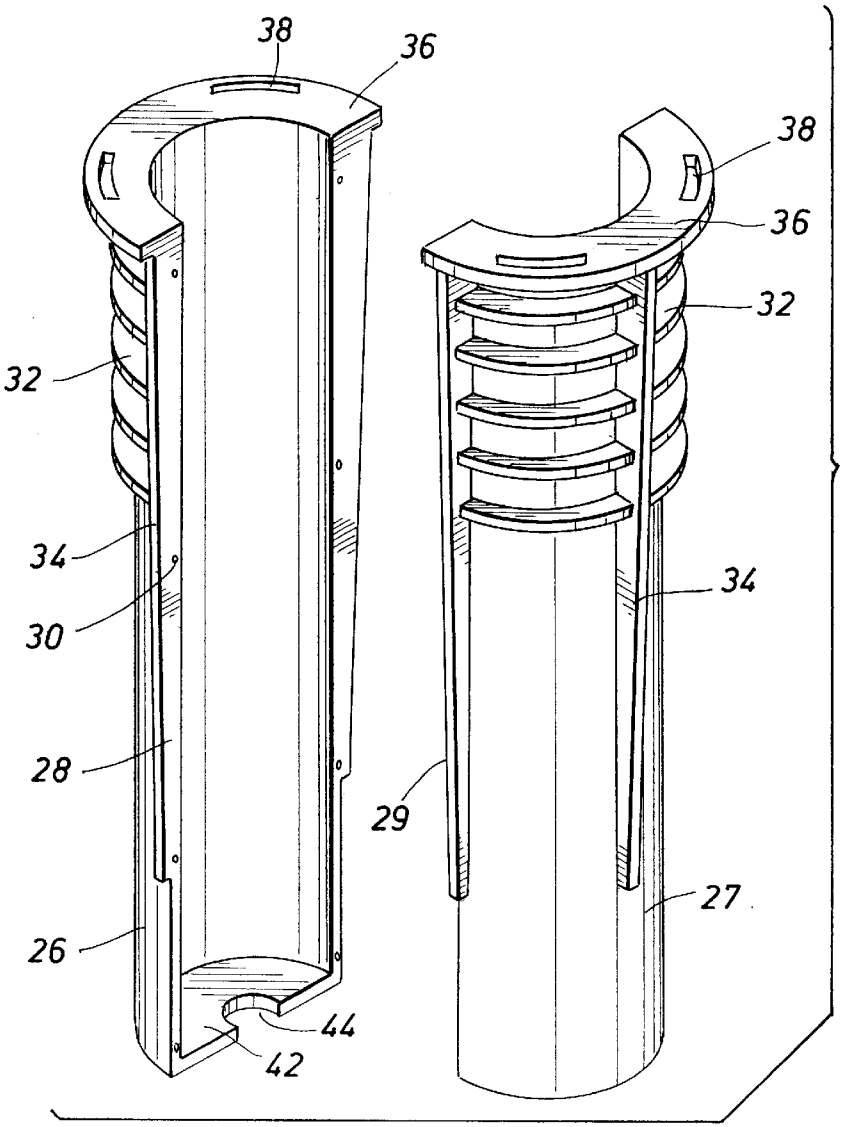
FIG. 3 is an exploded view of the split sleeve bushing of the invention.
Figure 2:
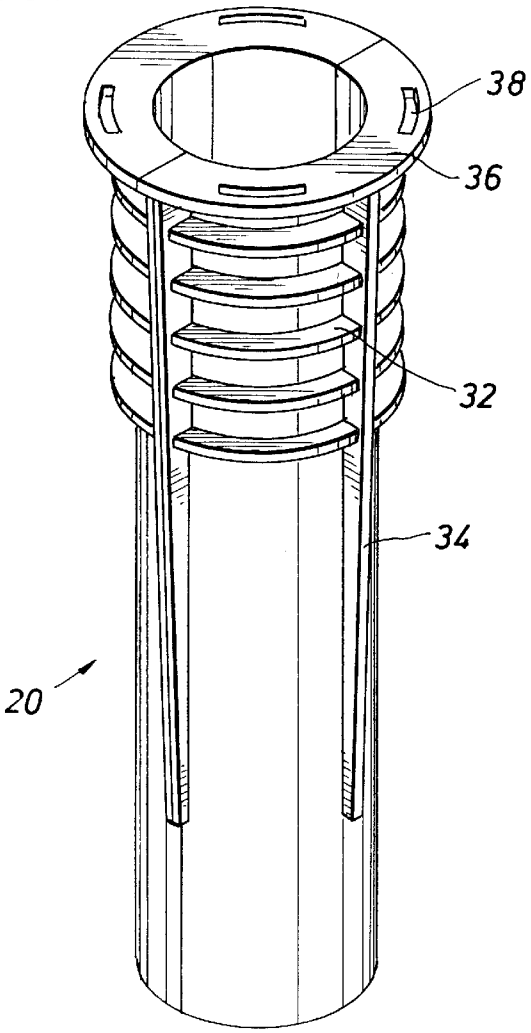
FIG. 2 is perspective view of the split sleeve bushing of the invention.

Referring now to FIGS. 2 and 3, the split sleeve bushing 20 of the invention is shown in greater detail. The sleeve bushing 20 comprises two substantially identical sleeve members 26 and 27 which mate together to form the sleeve bushing 20. Upon assembly, the sleeve bushing 20 defines a substantially cylindrical body as shown in FIG. 2.

The sleeve members 26 and 27 include longitudinal edges 28 and 29 which upon assembly of the sleeve bushing 20, as shown in FIG. 2, are in facing engagement. Alignment of the sleeve members 26 and 27 in facing engagement is maintained by a combination of holes and pins formed on the edges 28 and 29 of the sleeve members 26 and 27. In the embodiment of the sleeve bushing 20 shown in FIG. 3, the sleeve member 26 includes two or more tapped holes 30 formed in the edge 28 of the sleeve member 26. The holes 30 are spaced along the length of the edge 28. A corresponding number of pins (not shown in the drawings) project from the edge 29 of the sleeve member 27. Upon assembly of the sleeve bushing 20, the pins of the sleeve member 27 are received in the holes 30 of the sleeve member 26 to form the substantially cylindrical sleeve bushing 20.

Referring still to FIGS. 2 and 3, the upper portion of the sleeve bushing 20 includes circumferential stiffening rings 32 extending radially outward from the external surface of the sleeve members 26 and 27. Several rings 32 are spaced about the upper portion of the sleeve bushing 20. The rings 32 provide additional strength and stability for supporting the gas cylinder 22 at the neck of the chair base hub 12.

The sleeve bushing 20 includes vertical ribs 34 formed on the outer surface thereof. The ribs 34 extend longitudinally along the outer surface of the sleeve members 26 and 27 and are drafted or tapered to match the internal draft angle of the chair base hub 12. Additionally, the ribs 34 provide strength and stability along the length of the sleeve bushing 20.

The upper open end of the sleeve bushing 20 is formed by a circumferential flange 36 which extends radially outward a sufficient distance to cover the top edge of the chair base hub 12. Slots 38 are formed in the flange 36 for receiving threrethrough flexible lock tabs 40, as best shown in FIG. 1, projecting from the top edge of the hub 12. The slots 38 and lock tabs 40 cooperate to snap lock the sleeve bushing 20 to chair base hub 12.

The lower end of the sleeve bushing 20 is partially closed by a bottom surface 42 extending inwardly from the lower edge of the sleeve members 26 and 27 as shown in FIG. 3. The surface 42 includes an opening 44 sized to receive the end of the gas cylinder piston 46. As shown in FIG. 5, the sleeve members 26 and 27 are mounted about the gas cylinder 22 so that the bottom surfaces 42 extend into a circumferential recess 48 formed in the piston 46 thereby locking or anchoring the end of the piston 46 to the sleeve bushing 20. Thrust bearing 50 and washers 52 and 54 are captured between the bottom surface 42 of the sleeve bushing 20 and a retaining shoulder 56 of the piston 46.

Placement of the gas cylinder 22 and the sleeve bushing 20 into the chair base 10 is accomplished by first sliding the washers 52 and 54 and the thrust bushing 50 on the lower end of the piston 46. The gas cylinder 22 is then placed in one of the sleeve members, such as sleeve member 26, so that the bushing 50 and washers 52 and 54 are captured between the bottom surface 42 of the sleeve member 26 and the shoulder 56 of the piston 46. The bottom surface 42 extends into the recess 48 of the piston 46. The second sleeve member 27 is placed over the cylinder 22 and piston 46 in alignment with the sleeve member 26 and snapped together with the sleeve member 26 to form the sleeve bushing 20 which encloses the lower portion of the gas cylinder 22. The gas cylinder 22 and sleeve bushing 20 are then inserted into the hub 12 of the chair base 10 so that the flexible lock tabs 40 extend through the flange 36 of the sleeve bushing 20, thereby locking the sleeve bushing and gas cylinder assembly to the chair base 10.

While a preferred embodiment of the invention has been shown and described, other and further embodiments of the invention may be devised without departing from the basic scope thereof, and the scope thereof is determined by the claims which follow.

We claim:

1. A bushing for a chair seat support post received within a support post receptacle of a chair base, comprising:

(a) a substantially cylindrical body open at an upper end and partially closed at a lower end thereof;

(b) means formed on an external surface of said cylindrical body for strengthening said cylindrical body; and (c) a circumferential flange extending radially outwardly from said upper end of said cylindrical body, said flange including slots for receiving lock tabs therethrough for locking said cylindrical body to the chair base.

2. The apparatus of claim 1 wherein said cylindrical body is split into two substantially identical sleeve members.

3. The apparatus of claim 1 wherein said means for strengthening said cylindrical body comprises circumferential rib members extending radially outwardly from said external surface of said cylindrical body.

4. The apparatus of claim 1 including longitudinally extending rib members formed on said external surface of said cylindrical body, said longitudinal rib members extending downwardly from said circumferential flange and tapering inwardly from said circumferential flange to a lower end of said rim members.

5. A chair base having a receptacle for receiving a lower end of a chair seat support post therein, the receptacle being open at an upper end and including an interior wall defining an internal draft angle, comprising:

(a) a bushing secured about the lower end of the support post, said bushing comprising a substantially cylindrical body open at an upper end and partially closed at a lower end thereof, (b) means formed on an external surface of said cylindrical body for strengthening said cylindrical body;

(c) lock tabs extending upwardly from the upper end of the chair base receptacle; and (d) a circumferential flange extending radially outwardly from said upper end of said cylindrical body, said flange including slots for receiving said lock tabs therethrough for locking said cylindrical body to the chair base.

6. The apparatus of claim 6 including longitudinally extending rib members formed on said external surface of said cylindrical body, said rib members being tapered to match the internal draft angle of the interior wall of the chair base receptacle for frictionally securing said bushing within the chair base receptacle.

* * * * *